US007164335B2

(12) United States Patent
Forsythe

(10) Patent No.: US 7,164,335 B2
(45) Date of Patent: Jan. 16, 2007

(54) SWITCH ASSEMBLY EMPLOYING MAGNETIC REED SWITCHES

(75) Inventor: Alan K. Forsythe, Kent, WA (US)

(73) Assignee: G.T. Development Corporation, Auburn, WA (US)

( * ) Notice: Subject to any disclaimer, the term of this patent is extended or adjusted under 35 U.S.C. 154(b) by 0 days.

(21) Appl. No.: 10/453,914

(22) Filed: Jun. 2, 2003

(65) Prior Publication Data

US 2004/0032311 A1 Feb. 19, 2004

Related U.S. Application Data

(60) Provisional application No. 60/385,169, filed on May 31, 2002.

(51) Int. Cl.
*H01H 9/00* (2006.01)

(52) U.S. Cl. ..... 335/207; 335/205; 335/151; 335/153

(58) Field of Classification Search ..... 335/205–207, 335/151–154

See application file for complete search history.

(56) References Cited

U.S. PATENT DOCUMENTS 3,243,544 A * 3/1966 Mayer ..... 335/206
3,401,366 A * 9/1968 Paholek et al. ..... 335/206
3,465,271 A * 9/1969 Koepke ..... 335/205
3,698,531 A * 10/1972 Bernin ..... 400/479.2
3,701,064 A * 10/1972 Kinoshita et al. ..... 335/205
4,453,148 A * 6/1984 Norakidze et al. ..... 335/205
4,627,277 A * 12/1986 Baer ..... 73/170.16

* cited by examiner

*Primary Examiner*—Elvin Enad
*Assistant Examiner*—Bernard Rojas
(74) *Attorney, Agent, or Firm*—Christensen O'Connor Johnson Kindness PLLC

(57) ABSTRACT

A three-position push-pull switch assembly is disclosed that includes two magnetic reed switches mounted to a circuit board located within the switch housing. A magnet is mounted to an actuator that extends into the switch housing and is axially translatable from a center position to a pushed in position and a pulled out position. When in the center position, the two magnetic reed switches are in a first closed-open operational state. When force is applied to the actuator shaft to move it into the pushed-in position, the reed switches are in a second closed-open operational state. Similarly, when force is applied to move the actuator shaft to the pulled out position, the magnetic reed switches are in a third closed-open operational state. A detent mechanism maintains the switch assembly in the center position when the actuator shaft is not being pulled or pushed away from that position and returns the switch assembly to the center position after being switched to either the pushed in or pulled out positions to thereby provide momentary push-pull operation.

8 Claims, 6 Drawing Sheets

SWITCH ASSEMBLY EMPLOYING MAGNETIC REED SWITCHES

CROSS-REFERENCE TO RELATED APPLICATION

This application claims the benefit of U.S. Provisional Application No. 60/385,169, filed on May 31, 2002.

FIELD OF THE INVENTION

This invention relates generally to switch assemblies and, more particularly, to manually actuated selector switches for low power (low current) applications.

BACKGROUND OF THE INVENTION

Manually actuated switches are used in a wide variety of applications. Of particular relevance to the present invention is the switching of low current signals that are suitable for use in a variety of situations, including relatively hostile environments with respect to humidity, temperature, and other conditions that may cause corrosion or oxidation of switch contacts. Of additional relevance to the invention are manually actuated momentary switches that provide a desired switch condition when manually actuated, but return to a different switch condition when released. In some of these momentary switching arrangements, it may be necessary or desirable for the switch to exhibit certain tactile characteristics such as the amount of force required for manually actuating the switch and/or tactile feedback often referred to as "snap-action." Further, a growing need exists for switch arrangements in which electrical components are incorporated within a switch assembly so that the switch assembly is capable of providing electrical signals for controlling various kinds of electronic and electrical devices.

Although the prior art has, in part, addressed the noted considerations and requirements, a need exists for a switch arrangement that singly or collectively offers improvement as to each of the noted structural and operational characteristics.

SUMMARY OF THE INVENTION

A switch assembly configured in accordance with the present invention includes an actuator shaft that projects inwardly into a switch housing. A magnet is mounted to the actuator shaft at a location within the interior of the housing. One or more magnetic reed switches are mounted in the interior of the housing unit at predetermined locations that are in relatively close proximity to the actuator shaft. Manual translation of the actuator shaft from one switch position to another moves the magnet to locations that determine open/closed electrical state of each of the magnetic reed switches.

The disclosed, exemplary embodiment of the invention includes two magnetic reed switches and is constructed and arranged to function as a three-position control switch for applying and releasing the parking brakes of a large truck. In that embodiment, when a knob that is mounted to the actuator shaft on the exterior of the switch housing is pulled outwardly, the shaft-mounted magnet moves from a centered position to place the magnetic reed switches in a first operational state that applies the parking brakes. When the knob is released, a spring-loaded detent mechanism causes the actuator shaft to return the magnet to its centered position and place the magnetic reed switches in a second operational state in which the truck brakes remain engaged. Pushing the knob inwardly toward the switch housing positions the magnet at a location that causes the reed switches to be in a third operational state that releases the parking brakes. When the knob is released, the spring-loaded detent mechanism causes the actuator shaft to return the magnet to its centered position (second operational state of the magnetic reed switches).

The spring-loaded detent mechanism of the disclosed, currently preferred embodiment of the invention includes contoured bearing surfaces that extend inwardly from oppositely disposed sides of the actuator shaft. A cylindrical roller located at the end of a plunger extends inwardly into each contoured surface. The plungers reside in recesses that are formed in the interior of the switch housing and are spring-loaded to urge the rollers against the contoured surface of their associated detent. As the actuator shaft is pushed inwardly or pulled outwardly, the rollers rotate following the path established by the contoured bearing surfaces. When the inward or outward switch activation force is removed, the force asserted on the rollers by the spring-loaded plungers causes the actuator shaft to return to the center position.

Preferably, in accordance with the invention, the geometry of the contoured bearing surfaces and the force asserted by the spring-plungers are established to provide a desired actuation force. In the disclosed currently preferred embodiment of the invention, the contoured bearing surfaces and force asserted by the springs establishes a switch actuation characteristic under which the force required to push the actuator shaft inwardly is greater than the force required to pull the actuator shaft. Further, to provide a "snap-action" tactile characteristic the contoured bearing surfaces of the currently preferred embodiment decrease in steepness or ramp angle relative to inward and outward displacement of the actuator shaft so that the force required to displace the shaft inwardly and outwardly decreases with shaft displacement.

An additional feature of the currently preferred embodiment of the invention is the mounting of the reed switches on a printed circuit board that is located in the interior of the switch housing in spaced apart juxtaposition with the actuator shaft. In the disclosed exemplary arrangement, the reed switches are positioned on the printed circuit board so that one of the reed switches is in the on state when the actuator shaft is in the center (detent) position; neither of the reed switches is in the on state when the actuator shaft is pulled outwardly; and, both reed switches are in the on state when the actuator shaft is pushed inwardly. In addition, in this embodiment, resistors are mounted to the printed circuit board, with the conductive pattern of the printed circuit board connecting a first resistor and the two reed switches in series with one another. Second and third resistors are respectively connected in parallel with the two reed switches. With this arrangement, the electrical network formed by the reed switches and the resistors establishes a voltage divider that can be used to generate control voltages. For example, when the currently preferred embodiment of the invention is used to apply and release the parking brakes of a truck, the network formed by the reed switches and resistors is connected to a brake control unit that supplies current to the reed switch-resistor network via a resistor that is located in brake control unit. In this application, the three operational states of the invention provide separate, predetermined voltages at the junction between the resistor of the brake control unit and the reed switch-resistor network to thereby cause the brake controller to selectively apply and release the truck brakes.

BRIEF DESCRIPTION OF THE DRAWINGS

The foregoing aspects and other features of this invention will become better understood and appreciated by reference to the following detailed description, when taken in conjunction with the accompanying drawings, wherein.

DETAILED DESCRIPTION OF THE PREFERRED EMBODIMENT

Figure 1:
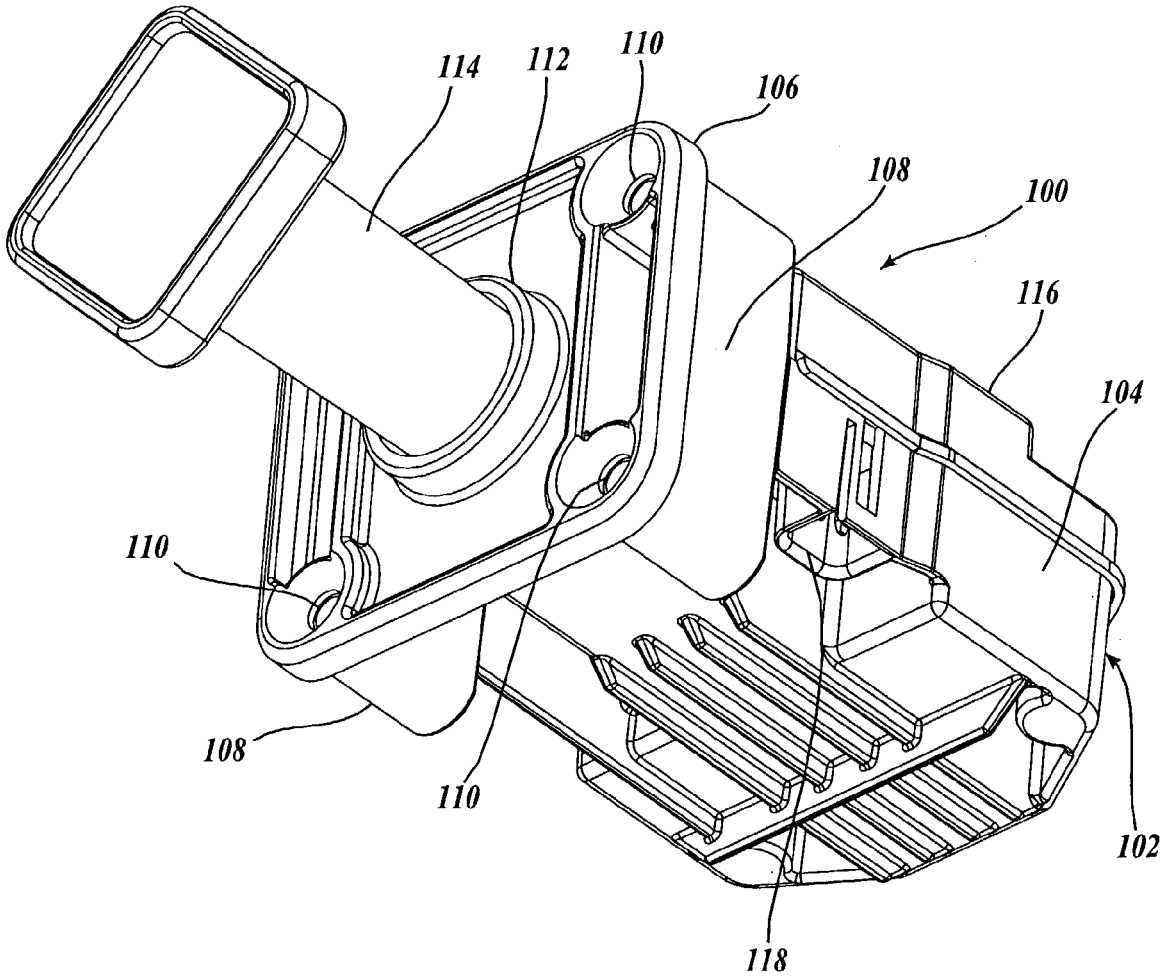
FIG. 1 is a perspective view of a switch assembly constructed in accordance with the present invention.

A switch assembly 100 that corresponds to the currently preferred embodiment of the invention is shown in FIG. 1. As described herein, switch assembly 100 is configured and arranged for applying and releasing the parking brakes of a large truck. However, upon understanding the invention, it will be apparent to a person skilled in the art that the invention can be used in numerous situations that call for a push-pull switch, pull switch, or a push switch. In the following description of switch assembly 100 it should be noted that terminology such as "top," "bottom," left," "right," etc., are used solely for descriptive purposes and therefore are not intended to limit the scope of the invention.

The switch assembly 100 shown in FIG. 1 includes a switch housing 102 which includes a lower housing unit 104. Formed at the forward end of lower housing unit 104 is a substantially rectangular mounting plate 106. Extending rearwardly along oppositely disposed edge regions of mounting plate 106 are mounting flanges 108. Countersunk threaded receptacles 110 extend into mounting flanges 108 at each corner of mounting plate 106 for fastening switch assembly 100 to a panel such as the dashboard of the truck.

Extending inwardly through a centrally located, circular flanged opening 112 in mounting plate 106 is a switch actuator 114. The portion of switch actuator 114 that extends through flanged opening 112 is a cylindrical shell, having a plate-like at its outward end that can be grasped to actuate switch assembly 100. An upper housing unit 116 extends rearwardly from the back surface of mounting plate 106 to enclose the upper portion of lower housing unit 104 and components of switch assembly 100 that are contained by the lower housing unit. In the depicted arrangement, upper housing unit 116 is joined to lower housing unit 104 by means of screws or other fasteners.

Preferably, lower housing unit 104, switch actuator 114 and upper housing unit 116 are formed by a conventional injection molding process. In that regard, the embodiment shown in FIG. 1 includes various cavity regions formed in the lower portion of lower housing unit 104 and mounting flanges 108. In addition, the lower surface of lower housing unit 104 includes a series of spaced apart axially extending flanges that project downwardly. Those skilled in the art will recognize that recesses of the types shown in FIG. 1 are conventionally employed to reduce the weight of a molded component, while flanges of the type shown in FIG. 1 are used to strengthen the molded object and, in some cases, to prevent cracking that can be caused by internal stresses that occur in injection molding processes.

Figure 2:
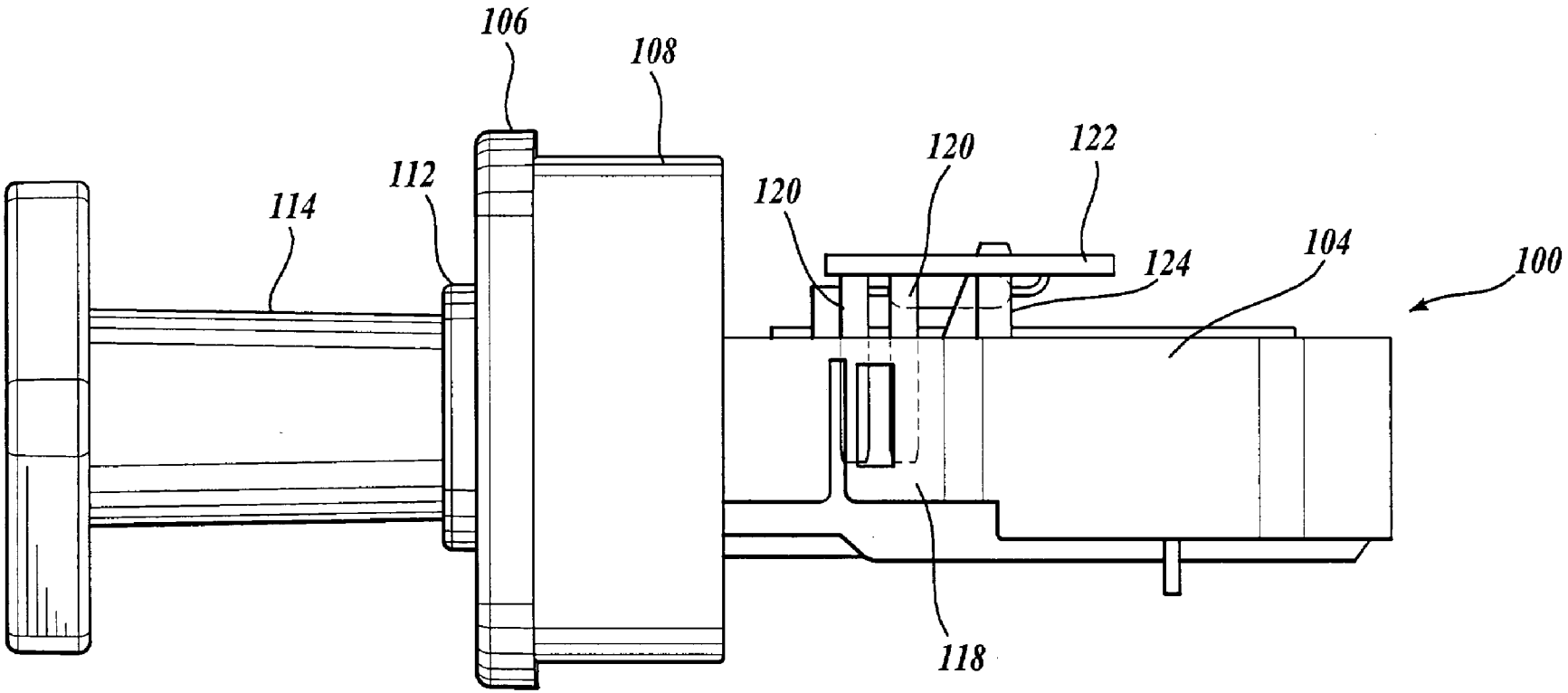
FIG. 2 is a side view of the switch assembly of FIG. 1, with the upper housing unit of the switch removed.

Also formed in the lower portion of lower housing unit 104 is a receptacle 118 for receiving an electrical connector that interconnects switch assembly 100 to external circuitry not shown in FIG. 1. As can be best seen in FIG. 2, two parallel spaced apart conductors 120 extend downwardly into receptacle 118 to form contact pins. As also shown in FIG. 2, the two conductors 120 terminate at their upper end at a circuit board 122.

Circuit board 122 of the currently preferred embodiment of the invention extends in parallel, spaced apart relationship with the upper surface of lower housing unit 104. In the depicted embodiment, a pair of upwardly extending spaced apart support posts 124 position circuit board 122 with the conductors 120 extending downwardly into receptacle 118. Preferably, the upper end of each support post 124 includes an annular shoulder upon which circuit board 122 rests. Included in circuit board 122 are openings substantially the same size as the upper ends of support posts 124 to allow mounting of the circuit board without screws or other fasteners and to securely maintain circuit board 122 in its mounted position. As will be described relative to FIGS. 6 and 7, in the disclosed embodiment of the invention, two reed switches and three resistors are located on the bottom side of circuit board 122 and are interconnected to form an electrical switching network.

Figure 3:
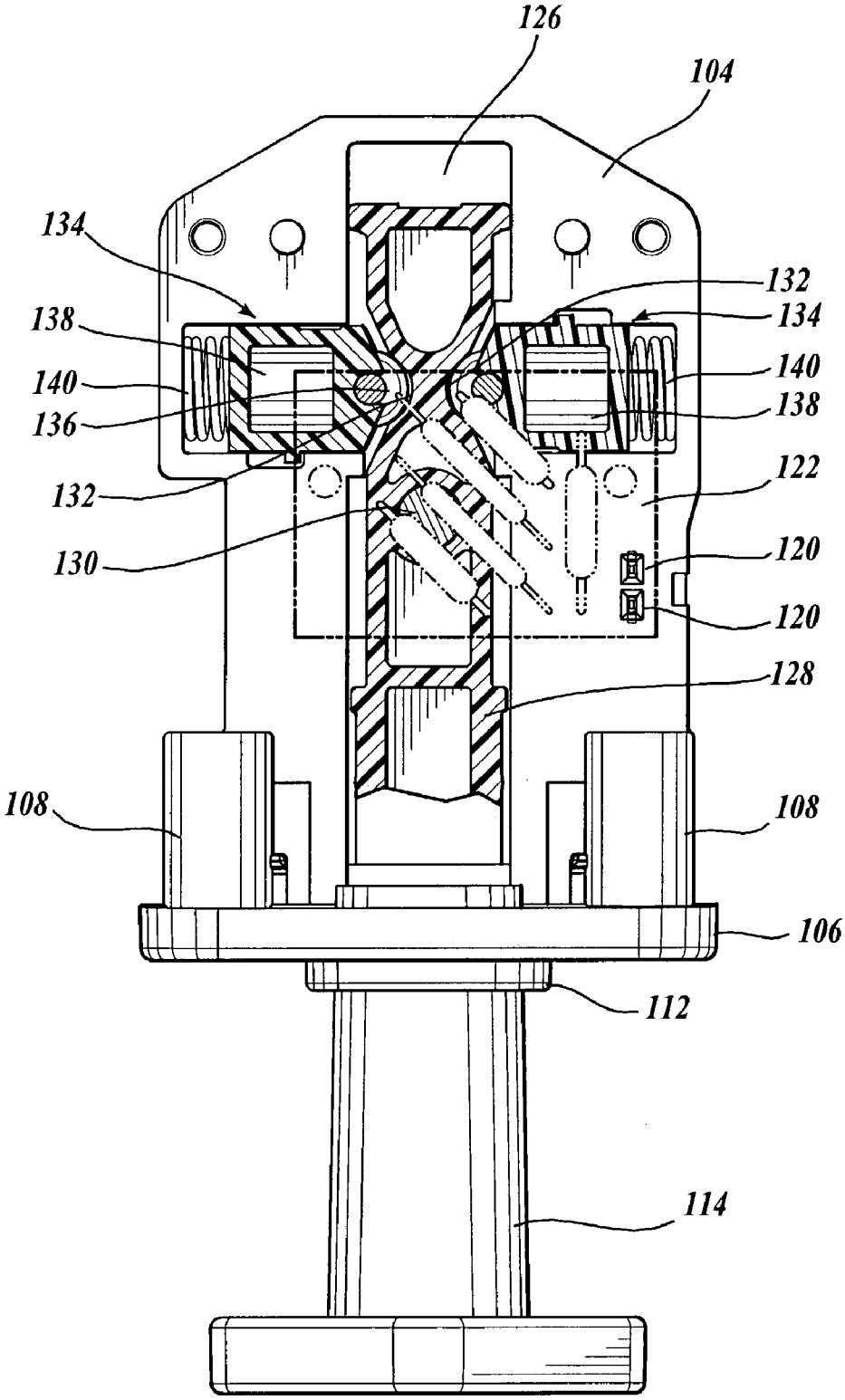
FIG. 3 is a top view of the switch assembly of FIG. 1, shown with the upper housing unit of the switch assembly removed and with the switch actuator shaft depicted in its center detent position.
Figure 4:
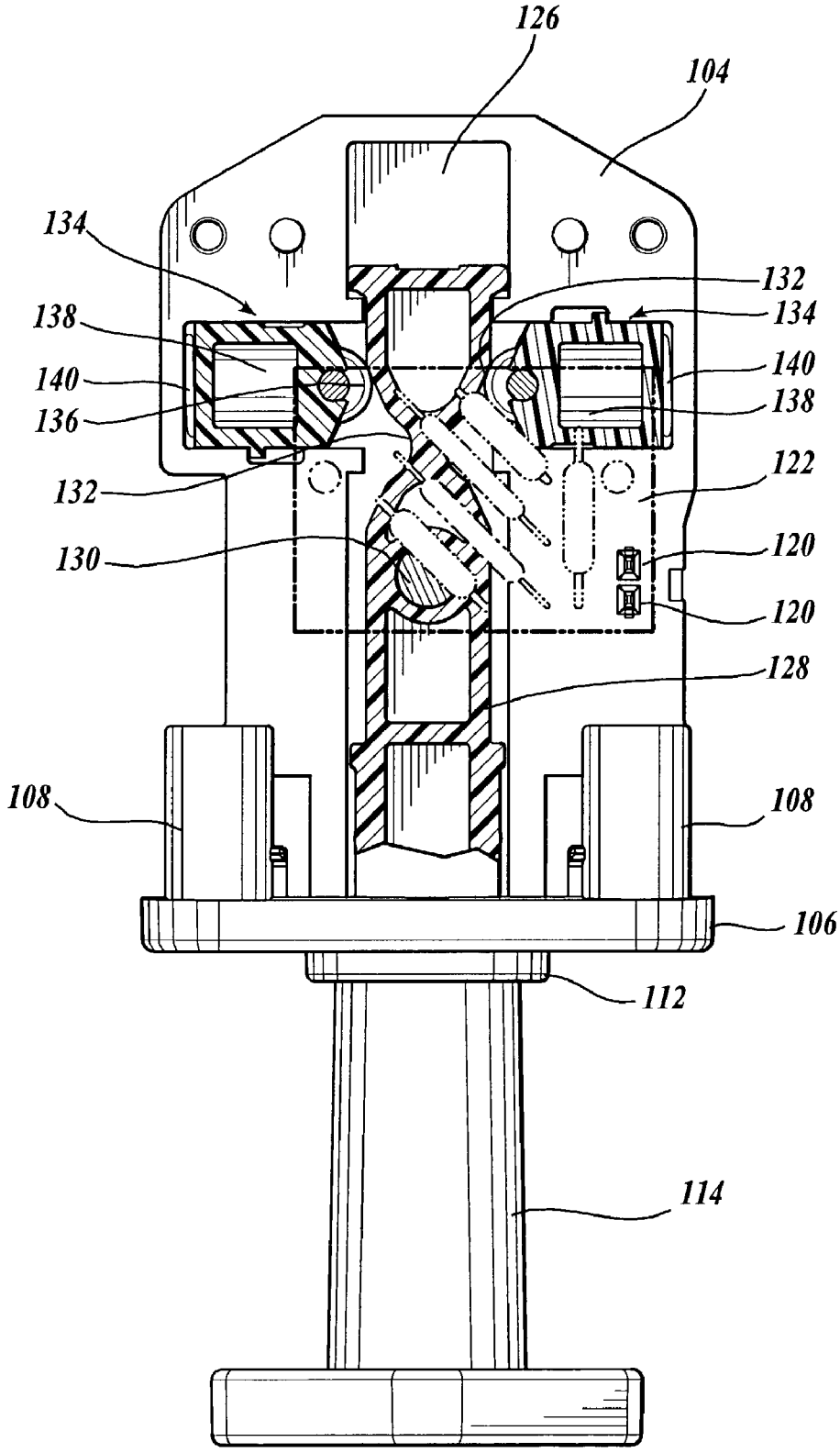
FIG. 4 is a top view of the switch assembly of FIG. 1, shown with the upper housing unit of the switch assembly removed and with the actuator shaft depicted in its pulled-out position.
Figure 5:
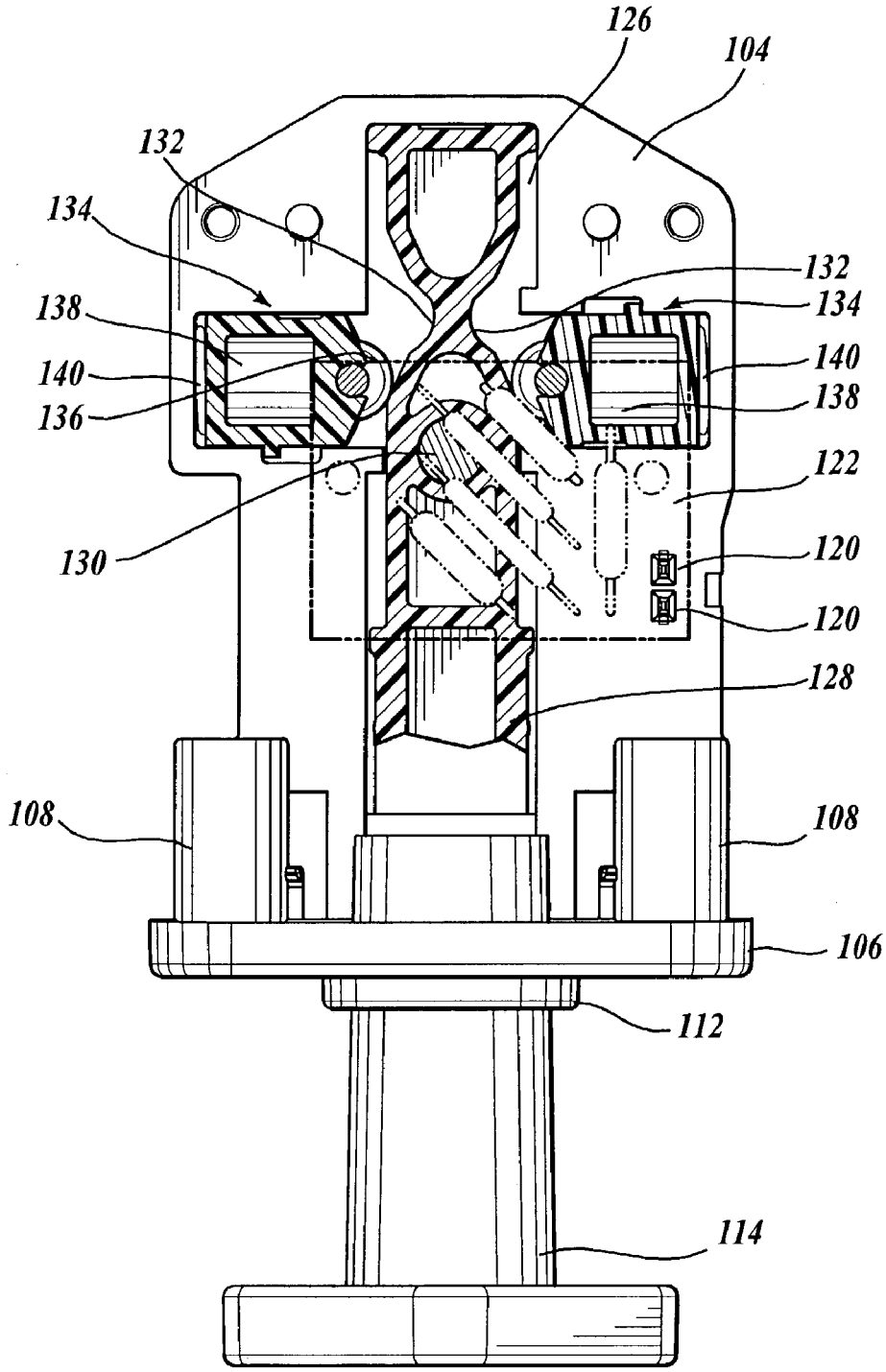
FIG. 5 is a top view of the switch assembly of FIG. 1, shown with the upper housing unit of the switch assembly removed and with the actuator shaft depicted in its pushed-in position.

FIGS. 3, 4 and 5 depict additional components of the depicted switch assembly 100. In addition, FIGS. 3, 4 and 5 respectively illustrate the structural relationship between components of switch assembly 100 for operational states in which: (1) switch assembly 100 is not activated (referenced herein as the "center" or "neutral" position of switch assembly 100; (2) switch assembly 100 is activated to a "pulled-out" position; and (3) switch assembly is activated to a "pushed-in" position.

With respect to internal switch components, FIGS. 3, 4 and 5, each show an actuator channel 126 that extends downwardly into lower housing unit 104 in axial alignment with flanged circular opening 112 and switch actuator 114. An elongate actuator shaft 128, which is sized for axial travel along actuator channel 126, is joined to and axially extends from switch actuator 114. Although actuator channel 126 and actuator shaft 128 of the currently preferred embodiments of the invention are of rectangular cross-sectional geometry, various other configurations (e.g., circular or semi-circular cross-sectional geometry) also may be used.

Regardless of the cross-sectional geometry employed, actuator shaft 126 includes magnet 130 which, in the depicted embodiment, is circular in cross-section and is press-fit into a cylindrical cavity that is formed in actuator shaft 126. Additionally, actuator shaft 126 includes first and second contoured bearing surfaces 132 that are oppositely disposed from one another and extend inwardly into the sides of actuator shaft 128. In the arrangement shown in FIGS. 3, 4 and 5, the contoured bearing surfaces 132 are located near the distal end of actuator shaft 128. In an earlier prototype of the invention, the contoured bearing surfaces 132 were located near the end of actuator shaft 128 that is joined to switch actuator 114.

In combination, contoured bearing surfaces 132 and spring-loaded roller assemblies (134 in FIGS. 3, 4 and 5) form a spring-loaded detent mechanism that maintains actuator shaft 128 of switch assembly 100 at its center, neutral position (FIG. 3), as long as force that is not sufficient to axially translate actuator shaft 128 along actuator channel 126 is not being applied to switch actuator 114. As is described relative to FIGS. 4 and 5, the spring-loaded detent assemblies cause switch assembly 100 to return to its centered, neutral position (FIG. 3) when switch actuator 114 is either pulled outwardly to place switch assembly 100 in the pulled-out position (FIG. 4) and released or is pushed inwardly to place switch assembly 100 in pushed-in position (FIG. 5) and released.

With continued reference to FIG. 3, each spring-loaded roller assembly includes a cylindrical roller 136, a plunger 138 and a compression spring 140. Plungers 138 are installed for sliding movement in detent channels 142 that are located in lower housing unit 104 and extend orthogonally away from actuator shaft 128. A compression spring 140 is installed between each plunger 138 and an end wall of the detent channel 142 in which the plunger 134 is located. A cylindrical roller 136 is mounted for rotation at the end of each plunger 138 that faces actuator shaft 128. In the depicted embodiment, mounting of the rollers 136 to their associated plungers 138 is facilitated by small circular shafts that extend from each end of a roller 136 with the axial center lines of the shafts being coincident with the axial center line of the associated roller. The plunger shafts are received by arcuate openings located in spaced apart flanges of the plungers 138. Preferably, the radius of the arcuate openings in which the shafts of the rollers are inserted are slightly smaller than the radius of the shafts so that each roller 136 is rotatably retained in an associated plunger 138.

As previously indicated, FIG. 4 depicts switch assembly 100 with switch actuator 128 pulled outwardly and away from switch housing 102 so that switch assembly 100 is in the pulled-out position. As is indicated in FIG. 4, outward travel of switch actuator 114 and, hence, actuator shaft 128 of the depicted embodiment is limited by tabular regions that extend outwardly from the distal end of actuator 128 coming into abutment with inwardly projecting tabular regions of actuator channel 126. As is shown in FIG. 4, when switch assembly 100 is at its pulled-out position, rollers 136 remain in contact with the contoured bearing surfaces 132 of actuator shaft 128. As a result, when pulling force is no longer asserted on switch actuator 114, the compression springs 140 urge the rollers 136 inwardly toward actuator shaft 128 thereby causing switch assembly 100 to be returned to its center, neutral position (shown in FIG. 3).

By comparing FIGS. 3 and 4, it can be noted that activation switch assembly 100 from the neutral, center position to the pulled-out position moves magnet 130 from a position below the central portion of circuit board 122 to a position located near the forward edge of circuit board 122. As will be described relative to FIGS. 6 and 7, the position of magnet 130 controls the closed-open state of two magnetic reed switches that are mounted to circuit board 122 so that the closed-open states of the reed switches uniquely define the operational state of switch assembly 100 (i.e., whether switch assembly 100 is at its neutral, center position; has been activated to its pulled-out position; or has been activated to the hereinafter described pushed-in position of FIG. 5.

Again referring specifically to FIG. 4, it can be noted that the steepness or ramp angle of each contoured bearing surface 132 decreases relative to the distance traveled by actuator shaft 128 during its translation from the neutral, center switch position. Thus, the amount of force required to move actuator shaft 128 from the neutral, center position decreases with outward movement of the actuator shaft. As is also indicated in FIG. 4, the portion of the contoured bearing surfaces 120 that are contacted by the rollers 136 when the actuator shaft 128 is in the centered, neutral position exhibits a relatively steep ramp angle. When configured in this manner, switch assembly 100 exhibits a snap-action tactile characteristic. By way of example in one realization of the currently preferred embodiment of the invention, the pulling force required to initiate movement of actuator shaft 128 is on the order of 30 Newtons, while the force required as the actuator shaft nears the pulled-out position is on the order of 20 Newtons.

As is shown in FIG. 5, when switch assembly 100 is in its pushed-in position, the inner end of actuator 128 comes into abutment with an end wall of actuator channel 126 to thereby limit inward movement of actuator shaft 128 and define the pushed-in position of switch assembly 100. With the switch assembly in the pushed-in position, magnet 130 is positioned closer to the innermost edge of circuit board 122 than the position occupied by the magnet when the switch assembly is in the neutral, center position. As shall be described in more detail, moving magnet 150 from the position occupied when switch assembly 100 is in the neutral, center position to the position it occupies when the switch assembly is in the pushed-in position changes the closed-open state of reed switches mounted on circuit board 122. In particular, the change in the location of magnet 130 places the magnetic reed switches in a closed-open state that uniquely identifies the pushed-in condition of switch assembly 100.

It can be seen in FIG. 5, that rollers 136 remain on contoured bearing surfaces 132 when switch assembly 100 is in the pulled-out position. Thus, when the force required to place switch assembly 100 in its pulled-out position is removed, compression springs 140 urge rollers 136 inwardly toward actuator shaft 128, causing switch assembly 100 to return to the neutral, center position shown in FIG. 3.

The portion of contoured bearing surfaces 132 that are traversed by rollers 136 as actuator shaft is pushed inwardly is configured in a manner similar to the portion traversed when actuator shaft 128 is moved to the pulled-out position of switch assembly 100. Specifically, the ramp angle or steepness of the contoured bearing surfaces 132 decreases as a function of the distance traversed by actuator shaft 128. Although the profile of the portion of the contoured bearing surfaces traversed during inward travel of actuator shaft 128 is similar to the profile traversed during inward travel, it need not be identical. In that regard, in the previously mentioned realization of the invention in which a pulling force on the order of 30 Newtons is required to initiate forward movement of actuator shaft 128, the profile of the rearmost regions of the contoured bearing surfaces is established so that a force on the order of 45 Newtons is required to initiate movement of actuator shaft 128 toward the pushed-in position.

Figure 6:
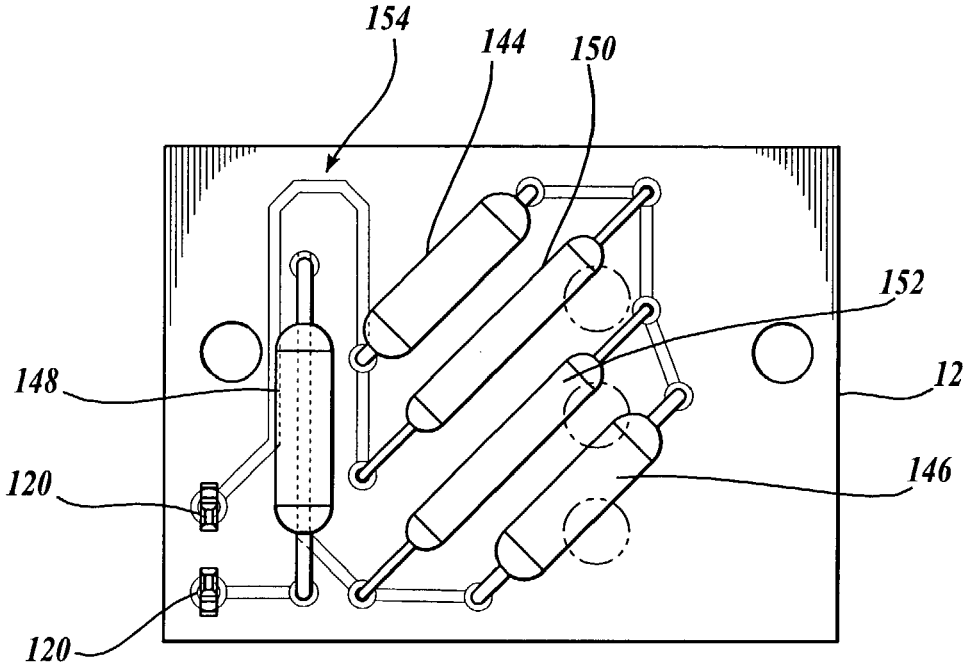
FIG. 6 depicts a printed circuit board, which includes magnetic reed switches and resistors that are employed in the currently preferred embodiment.
Figure 7:
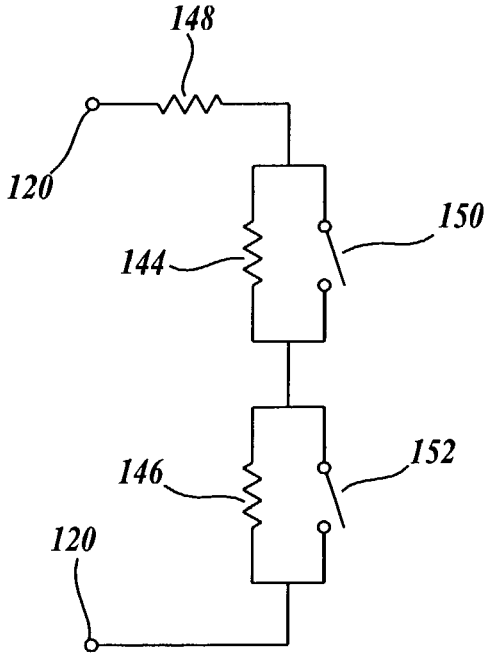
FIG. 7 is a schematic diagram of the resistor and magnetic reed switch arrangement that corresponds to the printed circuit board arrangement of FIG. 6.

FIGS. 6 and 7 respectively illustrate a printed circuit board that corresponds to printed circuit board 122 of the currently preferred embodiment of the invention and a schematic diagram that corresponds to the depicted printed circuit board. Mounted on printed circuit board 122 are three resistors 144, 146 and 148, and additionally, two magnetic reed switches 150 and 152. The printed circuit metallization pattern 154 shown in FIG. 6 interconnects the resistors and magnetic reed switches in the manner indicated by the schematic diagram of FIG. 7. In particular, resistor 148 and magnetic reed switches 150 and 152 are connected in series between the two electrical terminals 120 that form connector pins in receptacle 118 of FIGS. 1 and 2. A resistor is connected in parallel with each of the magnetic reed switches 150 and 152, with resistor 144 being connected in parallel with reed switch 150 and resistor 148 being connected in parallel with reed switch 152.

The location of magnet 130 when switch assembly 100 is in the neutral, center position (FIG. 3), the pulled-out position (FIG. 4) and the pushed-in position (FIG. 5) is indicated in FIG. 7 by dashed outlines 156*a*, 156*b* and 156*c*. When magnet 130 is at the location indicated by 156*a*, the magnetic field of magnet 130 closes magnetic reed switch 152 while leaving magnetic reed switch 150 in its open state. Thus, the electrical network schematically shown in FIG. 7 effectively becomes resistor 148 in series with resistor 144. When switch actuator 114 is pulled outwardly to place the switch assembly in the pulled-out position, magnet 130 moves from the location indicated by 156*a* to the location indicated by 156*b*. As magnet 130 moves away from magnetic reed switch 152, the reed switch reverts to an open condition. Since magnetic reed switch 152 is also in the open condition, the network schematically shown in FIG. 7 becomes the series connected combination of resistors 144, 146 and 148. On the other hand, when switch actuator 114 is moved inwardly to place switch assembly 100 in the pushed-in position, magnet 130 moves from the location indicated in FIG. 6 by 156*a* to the location indicated by 156*c*. As magnet 130 reaches location 156*a*, the magnetic field produced by magnet 130 causes reed switch 150 to close, while also maintaining reed switch 150 in a closed state. Thus, the network schematically shown in FIG. 7 is reduced to a single resistor (resistor 148).

When the embodiment of the invention disclosed herein is used for applying and releasing truck brakes, a truck brake control unit (not shown in the FIGURES.) interconnects terminals 120 of FIGS. 6 and 7 with a brake control unit. A voltage source located in the brake control unit supplies current to the electrical network schematically shown in FIG. 7 via a resistor of a known value (also located in the brake control unit). It can be noted that, in such an arrangement, the voltage developed between the two electrical terminals 120 indicates whether switch assembly 100 is in the neutral, centered position, is being pulled out to apply the brakes or is being pushed in to release the brakes. By way of example when a voltage source of 5 volts is connected to the circuit arrangement shown in FIGS. 6 and 7 via a 1.5 KOhm resistor and the values of resistors 144, 146 and 148 are 1 KOhm, 3 KOhm and 560 Ohms, a voltage substantially equal to 2.5 volts dc is present between the terminals 20 when switch assembly 100 is in the neutral, center position; a voltage substantially equal to 1.25 volts dc when the switch assembly is in the pulled-out position and a voltage substantially equal to 1.5 volts dc is supplied when switch assembly 100 is in the pushed-in position.

While the preferred embodiment of the invention has been illustrated and described, it will be appreciated that various changes can be made therein without departing from the spirit and scope of the invention. For example, a momentary action push switch or pull switch can be realized using a single reed switch. Further, by using more than two reed switches and additional magnets, push-pull switches that perform more complex switching operations than are specifically described herein can be achieved. Moreover, as previously mentioned, the cross-sectional geometry of various components can be other than the cross-sectional geometry employed in the disclosed embodiment of the invention.

The embodiments of the invention in which an exclusive property or privilege is claimed are defined as follows:

1. A switch assembly comprising:

a switch housing;

an elongate actuator shaft projecting inwardly into said switch housing, said actuator shaft being axially displaceable between three predetermined switch positions;

a magnet mounted to said actuator shaft, said magnet being positioned within said housing at separate predetermined locations that correspond on a one-to-one basis with said three predetermined switch positions;

first and second magnetic reed switches, said first and second magnetic reed switches being mounted at locations within said housing relative to said elongate actuator shaft and said magnet to place said magnet at locations that cause said first and second reed switches to be in a first open-closed circuit operational state when said switch is in the first of said three predetermined switch positions, to be in a second open-closed circuit operational state when said switch is in the second of said three predetermined switch positions, and to be in a third open-closed operational state when said switch is in the third of said three predetermined switch positions.

2. The switch assembly of claim 1, wherein the inward and outward displacement of said actuator shaft are limited to a predetermined distances, said magnet being located centrally between said inward and outward displacement limits of said actuator shaft when said switch assembly is in said first position, said actuator shaft being at its outward displacement limit when said switch assembly is in said second position, and said actuator shaft being at its inward displacement limit when said switch assembly is in said third position, and wherein said switch assembly further comprises a spring-loaded detent mechanism for maintaining said switch assembly in said first position in the absence of an inward or outward force sufficient to move said actuator shaft toward said second or third position, said spring-loaded detent mechanism returning said switch assembly to said first switch position location when said switch assembly is actuated to one of said second switch positions and the actuation force is removed.

3. The switch assembly of claim 2, wherein the spring-loaded detent mechanism comprises first and second contoured bearing surfaces and first and second spring-loaded plunger assemblies, said first and second contoured bearing surfaces being oppositely disposed from one another and extending inwardly into said actuator shaft at a location that establishes said first position of said switch assembly, said first and second spring-loaded plunger assemblies each including a spring, a cylindrical roller, and a plunger having first and second ends, said roller being mounted for rotation at the first end of said plunger, said first and second plungers being respectively received for sliding movement in first and second recesses that are formed in the interior of said switch housing and are located at a position adjacent said first and second contoured bearing surfaces when said switch assembly is in said first switch position, each said first and second recess having a wall at one end thereof with the second end being open and facing said actuator to position the roller associated with the plunger next to said actuator shaft, said spring of each said spring-loaded plunger assembly being located between said wall of said recess the plunger contained in said recess to urge the roller associated with said plunger against said actuator shaft.

4. The switch assembly of claim 3, wherein the contour of said contoured bearing surfaces and the force asserted by said spring-loaded plungers establish a force-displacement relationship in which the force required to move said elongate actuator shaft from first switch position toward one of said second and third switch positions varies as a function of displacement distance, with the force required for initial displacement being greater than the force required for continued displacement.

5. The switch assembly of claim 4, wherein the force-displacement relationship of said contoured bearing surfaces and said spring-loaded plungers are established so that more force is required to axially displace said elongate actuator shaft toward one of said second and third switch positions than is required to displace said elongate switch actuator shaft toward the other of said second and third switch positions.

6. The switch assembly of claim 1 further comprising a circuit board mounted within said switch housing in spaced apart juxtaposition with said actuator shaft, said first and second reed switches being mounted to said circuit board at said locations that cause said first and second reed switches to be in a first open-closed circuit operational state when said switch is in the first of said three predetermined switch positions, to be in a second open-closed circuit operational state when said switch is in the second of said three predetermined switch positions, and to be in a third open-closed operational state when said switch is in the third of said three predetermined switch positions.

7. The switch assembly of claim 6 wherein said first and second magnetic reed switches are connected in series with one another and wherein said circuit board includes first and second electrical terminals, said switch assembly further comprising first, second and third resistors, with said first resistor being electrically connected between said first electrical connector and one of said first and second series connected magnetic reed switches, said second electrical terminal being electrically connected to the second one of said first and second magnetic reed switches, said second resistor being electrically connected in parallel with said first magnetic reed switch and said third resistor being electrically connected in parallel with said second magnetic reed switch.

8. The switch assembly of claim 7 wherein said switch housing includes a receptacle for receiving an electrical connector and said first and second electrical terminals extend outwardly from said circuit board to form electrical contacts that mate with electrical contacts of said electrical connector.

* * * * *

UNITED STATES PATENT AND TRADEMARK OFFICE

CERTIFICATE OF CORRECTION

PATENT NO. : 7,164,335 B2
APPLICATION NO. : 10/453914
DATED : January 16, 2007
INVENTOR(S) : A.K. Forsythe It is certified that error appears in the above-identified patent and that said Letters Patent is hereby corrected as shown below:

| COLUMN | LINE | |
|---|---|---|
| 8 | 35 | "a predetermined distances," should read |
| (Claim 2, | line 3) | --predetermined distances,-- |

Signed and Sealed this

First Day of May, 2007

JON W. DUDAS
*Director of the United States Patent and Trademark Office*